United States Patent [19]

Buergel

[11] 4,254,628

[45] Mar. 10, 1981

[54] SLIDING-VALVE IN A HEATING-CHAMBER COMBUSTION ENGINE

[76] Inventor: George K. Buergel, 6 Stone Rd., Plainview, N.Y. 11803

[21] Appl. No.: 930,370

[22] Filed: Aug. 2, 1978

[51] Int. Cl.[3] ..... F02G 1/02

[52] U.S. Cl. ..... 60/682; 60/645; 60/517; 91/325

[58] Field of Search ..... 60/650, 682, 516, 517, 60/643, 645, 670, 651, 671; 91/325, 234

[56] References Cited

U.S. PATENT DOCUMENTS

| | | | |
|---|---|---|---|
| 4,120,161 | 10/1978 | Gedeit | 60/682 |
| 4,136,523 | 1/1979 | Pronorost | 60/517 |

*Primary Examiner*—Allen M. Ostrager

[57] ABSTRACT

A heating-chamber is provided for a heating-chamber combustion engine. A piston is provided with a detachable extension on the flat bottom of the piston, which towers upwardly and reaches during the upstoke into a pocket of the cylinder head. The detachable extension has a slit located close to the bottom of the piston. An opening in the cylinder wall is provided, opening a path to the heating-chamber. The path is located near the cylinder head so, that in the highest position of the piston the slit in the detachable extension and the opening in the cylinder wall line up with each other, keeping the opening in the cylinder wall closed in all but the highest position of the piston.

1 Claim, 6 Drawing Figures

Fig. 2
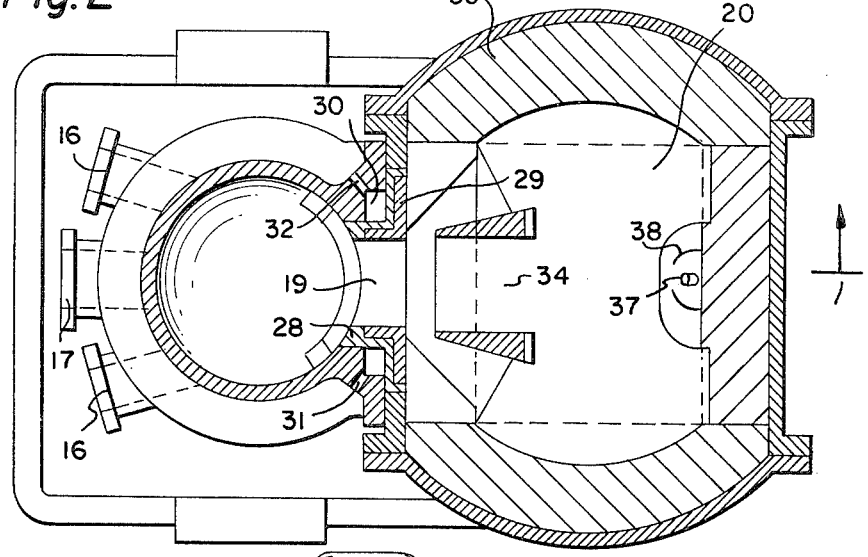
Fig. 6
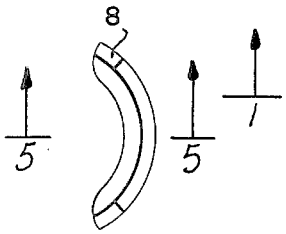
Fig. 5
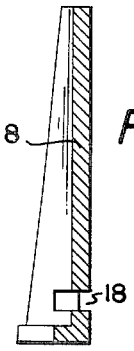
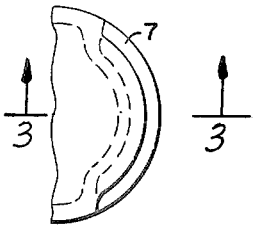
Fig. 4
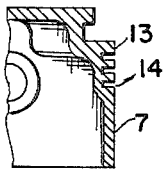
Fig. 3
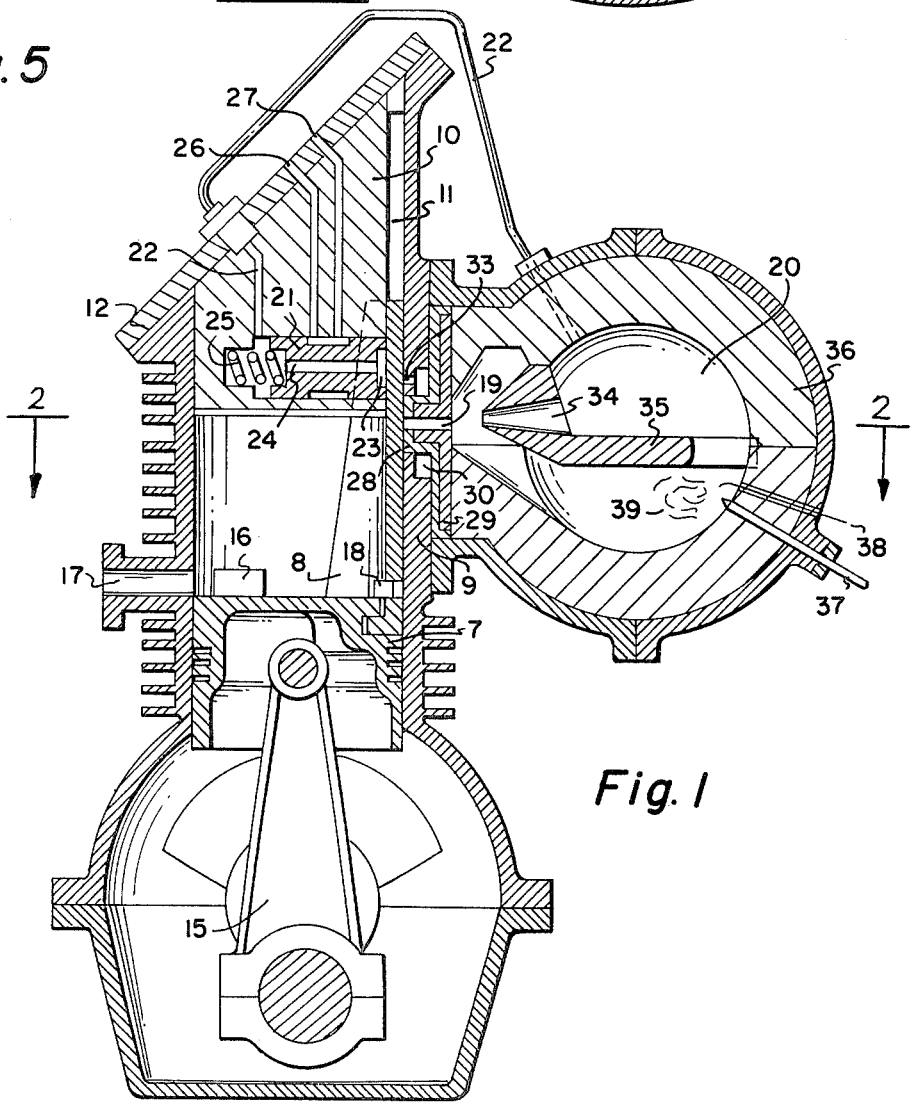
Fig. 1

SLIDING-VALVE IN A HEATING-CHAMBER COMBUSTION ENGINE

BACKGROUND OF THE INVENTION

A heating chamber combustion engine is an engine such as that shown and described in my patents U.S. Pat. No. 3,994,135 issued Nov. 30, 1976 and U.S. Pat. No. 4,096,689 issued June 27, 1978 in which a piston, connected to a crankshaft, moves up and down in a cylinder. In the lowest position of the piston the cylinder is flushed and filled with clean air from a loading pump. This is similar to two cycle combustion engines. The clean air is compressed by the up going piston to 1/6 or ⅛ or 1/10 or even less of its original volume. As soon as the piston reaches the position at which the desired compression ratio is attained, a slit opens, which connects the space above the piston with the interior of a chamber, which is located adjacent to the cylinder. The piston does not stop its motion at this point. It continues to move further up and pushes the compressed air, which was above the piston thru the slit into the adjacent chamber. Several cylinders, as many as desired, can be connected to the same chamber.

The air, which is blown into the chamber in the form of a jet stream reaches into the background of the chamber, where it meets a constant burning flame, which is maintained by injection of fuel into the chamber. The chamber is called the heating chamber. The heating chamber walls are covered by a thick layer of zirconium-oxide, which is a very effective insulator against loss of heat and can be used up to 2400° C. (4400° F.–4600° F.). The compressed air in the heating-chamber can therefore be heated up to 1500° C., which is more than double or three times the temperature of the incoming compressed air from the cylinder.

Upon reaching the end of the cylinder the piston reverses its movement and the space above the piston is again increased. The slit, which connects the space above the piston with the interior of the heating chamber remains open to the same position of the piston, where it was opened before. Therefore, the space above the piston is filled with hot air, which came from the foreground of the interior of the heating chamber.

An equal amount of air in weight must leave the heating chamber as was blown in earlier. Since the air, which was blown in had a much lower temperature it had a small volume. In order to get the same amount of air in weight out again, the pressure of the outcoming air has to be much higher. This means, that the pressure in the heating chamber adjusts itself to the temperature of the outcoming air. This pressure is much higher than the pressure, which was achieved above the piston when the air was compressed to 1/6 or ⅛ or 1/10 of its original volume. So, when the slit opens at this position a much higher pressure in the heating chamber will be encountered, which will raise the pressure above the piston to the pressure in the heating chamber. The piston must from then on push the whole cylinder content against this higher pressure into the heating chamber. The energy, required to do this is returned to the piston, when the much hotter air from the heating chamber returns at the down stroke to the piston until the slit closes again. The expansion of the hot air above the piston starts from the high pressure level of the heating chamber.

SUMMARY OF THE INVENTION

The object of the present invention is the connection and the sealing between the cylinder and the heating chamber of such an engine.

Opening and closing of the slit, which makes the connection between the cylinder and the heating chamber during a small portion of the stroke of a piston, requires a very high opening and closing speed especially at high RPM of an engine. The time, required, is much too short to be managed by a valve. Besides, a valve can not handle hot and very hot gases since the streaming gases represent a very large heat-capacity. The valve would have to be made from very special material. A sliding plate with a slit opening can readily achieve very high opening and closing speeds and can handle very hot gases since the streaming gases do not touch the sealing surfaces. The inside of the slit can be covered with high heat resisting and low conducting material like plasma sprayed 20% inconel with 80% zirconium-oxide or other ceramic or tungsten carbide inserts. The sealing surface slides along hot gases, but since the hot gases are stationary is their heat-capacity very small and since the contact area is moving, the temperature increase of the sliding and sealing plate is very small, so that even a material such as aluminum can withstand it.

BRIEF DESCRIPTION OF THE DRAWINGS

In the accompanying drawings:

FIG. 1 is a cross section thru a one cylinder heating-chamber combustion engine using the sealing mechanism which is the subject of this invention.

FIG. 2 is a section taken along the line 2—2 thru the one cylinder heating chamber engine of FIG. 1.

FIG. 3 is a cross section thru a piston provided with a groove for the attachment of the sealing extension.

FIG. 4 is a view of the piston from above.

FIG. 5 is a section taken along the line 5—5 of FIG. 6 showing the extension, which is attachable to the piston.

FIG. 6 is a view of the extension, which is attachable to the piston.

DETAILED DESCRIPTION

As shown in FIGS. 1 and 2, piston 7 carries an extension 8, which is attached to the piston 7 and slides along the wall of the cylinder 9. The cylinder 9 is closed on top by a cylindrical insert 10, which has a cutout 11 at one side to provide just enough space to accomodate the extension 8 in its highest position. The cylindrical insert 10 provides a tight fit so, that in the highest position of the piston almost no air-space is left between the extension 8, the piston 7 and the cylindrical insert 10. The cylindrical insert 10 and the cylinder 9 are cut at an angle on the top to save weight and material and are screwed and sealed to the outside by a coverplate 12. The piston 7 carries piston-rings 13, an oil-ring 14 and is connected to a crankshaft by a connecting rod 15. The piston 7 uncovers in its lowest position two inlet ports 16 and one exhaust port 17. In the piston extension 8 is a slit 18, which communicates in the highest position of the piston 7 with the path 19 to the heating-chamber 20. In any position other than the highest the piston extension 8 keeps the path 19 closed.

In order to provide an effective sealing the piston-extension 8 is pressed against the wall of the cylinder 9 by a sealing piston 21, which is built into the cylindrical insert 10. The sealing piston is loaded by the gas-pressure from the heating-chamber 20 to which it is connected by a pipe 22. The piston extension 8 is free to be pushed against the wall of the cylinder 9 since it is attached to the piston 7 so, that it can be shifted radially to the piston 7 for a small amount. The sealing piston 21 has a recess 23 at the end, which touches the piston extension 8. The recess 23 is connected thru a hole 24 to the gas-pressure in the heating-chamber also. The rim around the recess 23 acts as a seal by pressing against the piston extension 8 but the main force, which presses the piston extension 8 against the wall of the cylinder 9 is created by the gas-pressure direct. This has the advantage to reduce the friction between the moving extension 8 and the sealing-piston 21. A small spring 25 holds the sealing-piston 21 initially in position. The sealing-piston 21 can also be replaced by a bellow.

In order to lubricate the sliding surfaces between the sealing piston 21 and the piston extension 8 and also to provide some cooling, oil is circulated under pressure thru the holes 26 and 27 around the sealing piston 21.

The advantage of this design is, that no sealing elements like a piston or similar has to be provided at the outside of the cylinder 9 toward the heating chamber 20 making a wide and short path 19 to the heating chamber possible.

To secure the corners at the entrance into the path 19 against burning off, the disc 28 surrounding the path 19 is made of high melting material as tungsten carbide. The cover-disc 29 made from ceramic as zirconium-oxide or others protects the path 19 from the side of the heating chamber 20.

A canal 30 surrounds the path 19. Pressure-oil is circulated thru this canal from the holes 31 and 32 to provide cooling and to lubricate the moving piston extension 7 thru the hole 33.

The air-jet coming out of the path 19 enters the diffusor 34, which is located at the dividing wall 35 inside the heating chamber 20. The inside of the walls of the heating chamber 20 are covered with an insulating ceramic 36 as zirconium-oxide.

Fuel is injected thru the nozzle 37, ignited by the ignitor 38 and burned with a steady burning flame 39.

I claim:

1. An open air cycle engine comprising:

(a) a cylinder;

(b) a piston slideably engaged within said piston;

(c) a cylindrical insert at the upper portion of the cylinder with a fluid passage provided therein;

(d) a heating chamber located in close proximity with the outer sidewalls of the cyliner;

(e) an air passageway in the cylinder sidewall providing communication with the heating chamber and the space within the cylinder, said passageway being located at a position approximately adjacent the top dead center of the piston's travel;

(f) a valve element mounted on the piston extending vertically upwards and in sliding contact with the inner cylinder wall, whereby the air passageway is closed by the valve element during substantially all of the piston travel;

(g) an opening in the valve element allowing communication between the air passageway and said chamber when said opening is aligned with the air passageway, said valve opening being in alignment with the air passageway only when the piston is approximately at it's top dead center of travel;

(h) conduit means from the heating chamber to the fluid passageway in said cylindrical insert;

(i) said fluid passageway extending into contact with the sliding valve element, whereby heated air from the heating chamber flows through the conduit to said fluid passageway to provide a pressurized fluid biasing the sliding valve element into close contact with the cylinder wall;

(j) further valve means for exhausting air from the cylinder after the piston has completed its working stroke.

* * * * *